United States Patent [19]

Wang

[11] Patent Number: 4,939,870

[45] Date of Patent: Jul. 10, 1990

[54] VERTICAL/HORIZONTAL DOUBLE-WAY GRINDING TYPE ABRASIVE BELT GRINDER

[76] Inventor: Tien-Wang Wang, No. 110-23, Hsing Pin Road, Tai Pin Hsiang Taichung Hsien, Taiwan

[21] Appl. No.: 337,972

[22] Filed: Apr. 14, 1989

[51] Int. Cl.[5] ..... B24B 21/00

[52] U.S. Cl. ..... 51/135 R; 51/142

[58] Field of Search ..... 51/135 R, 142, 3, 72 R, 51/102

[56] References Cited

U.S. PATENT DOCUMENTS 3,133,384 5/1964 Liard ..... 51/142

4,201,254 5/1980 Fehric ..... 51/135 R

*Primary Examiner*—Frederick R. Schmidt

*Assistant Examiner*—M. Rachuba

*Attorney, Agent, or Firm*—Varndell Legal Group

[57] ABSTRACT

The present invention is directed to a vertical/horizontal double-way grinding abrasive belt grinder which includes a base and a horizontal grinding wheel head. The base has a vertical grinding wheel and an assembly chamber arranged at its top. The vertical grinding wheel can be adjusted within an angle of 45° with respect to the top of the base. The assembly chamber includes four positioning blocks respectively spaced about an opening at the top of the base for mounting thereon a cover plate or the horizontal grinding wheel head. The horizontal grinding wheel includes a housing and an abrasive belt wheel which are arranged to cooperate with the vertical grinding wheel for an abrasive belt to rotate thereabout. A vibration mechanism is provided within the horizontal grinding wheel head, which includes a worm coaxially connected to the abrasive belt, a worm gear engaging the worm and having an eccentric gear wheel thereon, and a roller wheel extending from the housing of the horizontal grinding wheel head and contacting the eccentric wheel. The vertical grinding wheel provides vertical grinding when the cover plate is mounted within the opening, and the vertical grinding wheel drives the abrasive belt for horizontal grinding with a vibrating motion when the horizontal grinding wheel head is mounted within the opening.

3 Claims, 5 Drawing Sheets

VERTICAL/HORIZONTAL DOUBLE-WAY GRINDING TYPE ABRASIVE BELT GRINDER

BACKGROUND AND SUMMARY OF THE INVENTION

The present invention is related to a grinding machine and, more particularly, to a grinder which can be used for vertical grinding as well as horizontal grinding, and which can provide a vibrating effect during grinding so as to enhance grinding performance.

Regular abrasive belt grinding machines include vertical grinding type and horizontal grinding type for respective grinding purpose. Because the grinding machines are independently operated for specific grinding purpose, two different types of machines are usually to be installed respectively when two different grinding purposes are needed. However, obtaining and installing two different types of grinding machines, namely vertical and horizontal types, is expensive and space consuming. The scope of the present invention is designed to solve this problem.

The main object of the present invention is to provide a vertical/horizontal double-way abrasive belt grinder, which includes a base for mounting a grinding wheel head, thereon and a vertical grinding wheel. The present invention can be arranged for vertical grinding by means of the vertical grinding wheel, and for horizontal grinding by means of an abrasive belt mounted over the vertical grinding wheel. For horizontal grinding an abrasive belt wheel is provided in the grinding wheel head. The griding wheel head can be arranged to provide a vibrating effect during the grinding process so as to reinforce or enchance grinding performance.

Other objects, features and advantages of the present invention will become more apparent from the following detailed description considered in connection with the annexed drawings as hereunder.

DETAILED DESCRIPTION OF THE PREFERRED EMBODIMENTS

Figure 1:
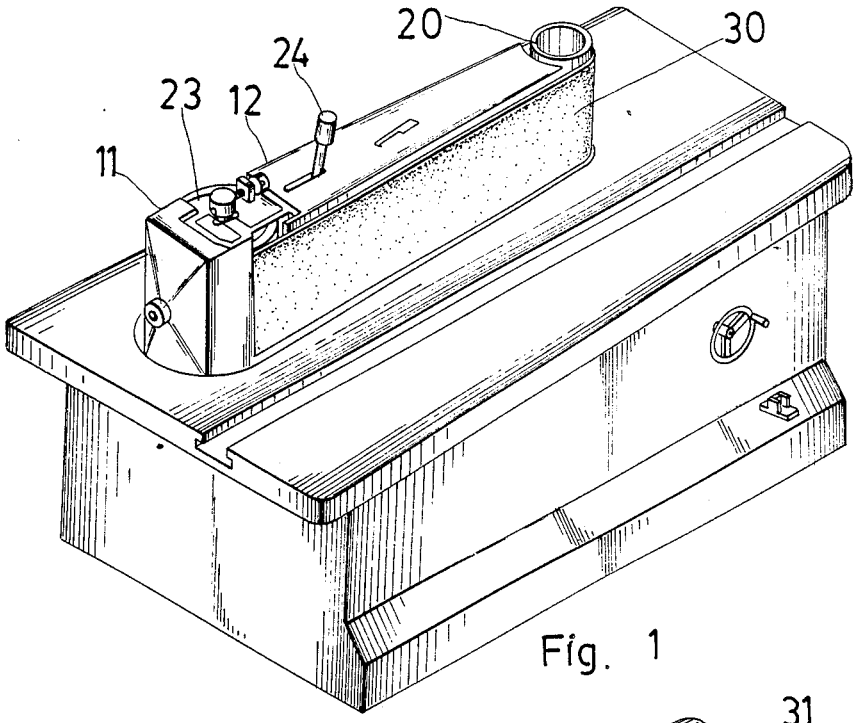
FIG. 1 is a perspective assembly view of the present invention.

Referring to FIGS. 1 through 6, a vertical/horizontal double/way grinding type abrasive belt grinder includes a base 10 and a horizontal grinding wheel head 11. The base has a horizontal top plate 31 a vertical grinding wheel 20 and an assembly chamber 21 respectively set at the top. The vertical grinding wheel 20 may be adjusted for angular position displacement within an angle of 45°. The assembly chamber has an opening 32 with four positioning blocks 22 respectively spaced from one another and extending from the bottom of the top plate 31. For vertical grinding a cover plate 33 can be mounted in the opening 32 by placing it on the positioning blocks. The horizontal grinding wheel head 11 which can be mounted on the assembly chamber 21 for horizontal grinding. The horizontal grinding wheel head 21 has an abrasive belt wheel 23, a control lever 24 set inside a housing 12, which is arranged at the right side of the abrasive belt wheel 23, to control the tension of the abrasive belt 30, which is mounted over the vertical grinding wheel 20 and the abrasive belt wheel 23. A worm 25 is coaxially mounted on the revolving shaft of the abrasive belt wheel 23 to drive a worm gear 26 in a rotating manner, which worm gear 26 has an eccentric wheel 27 arranged to contact with a roller wheel 28, which is set at the left side of the housing 12.

Figure 2:
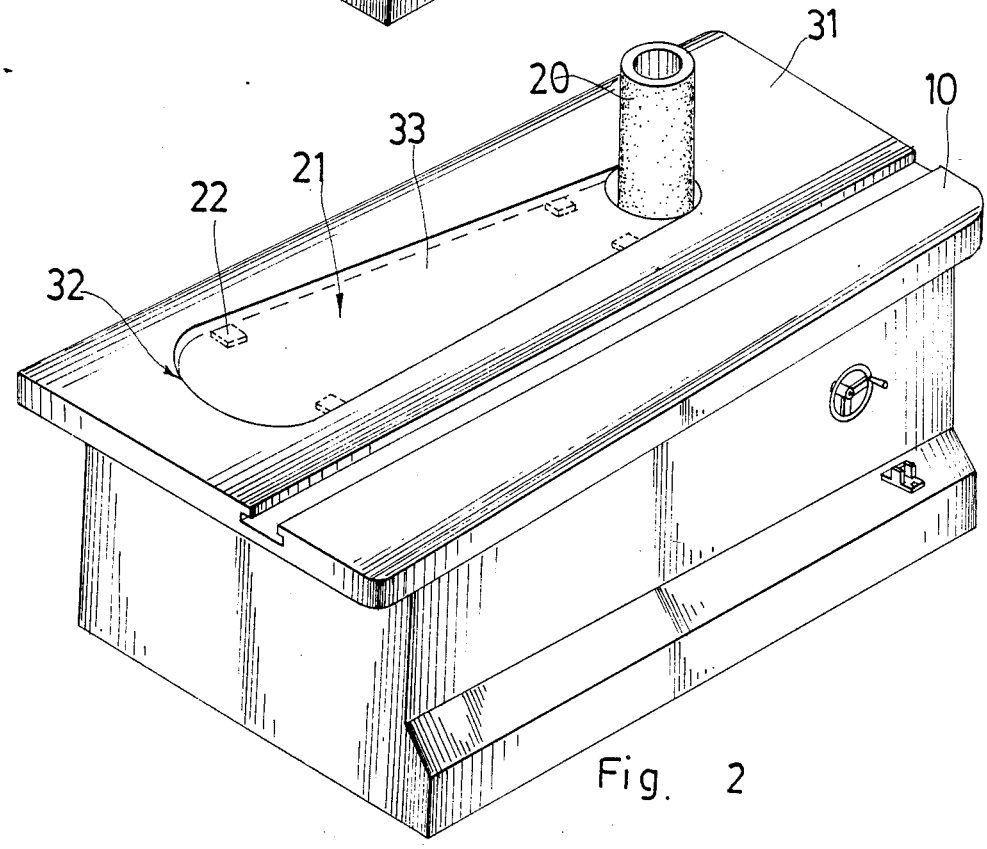
FIG. 2 is a perspective view of the base of the present invention.
Figure 3:
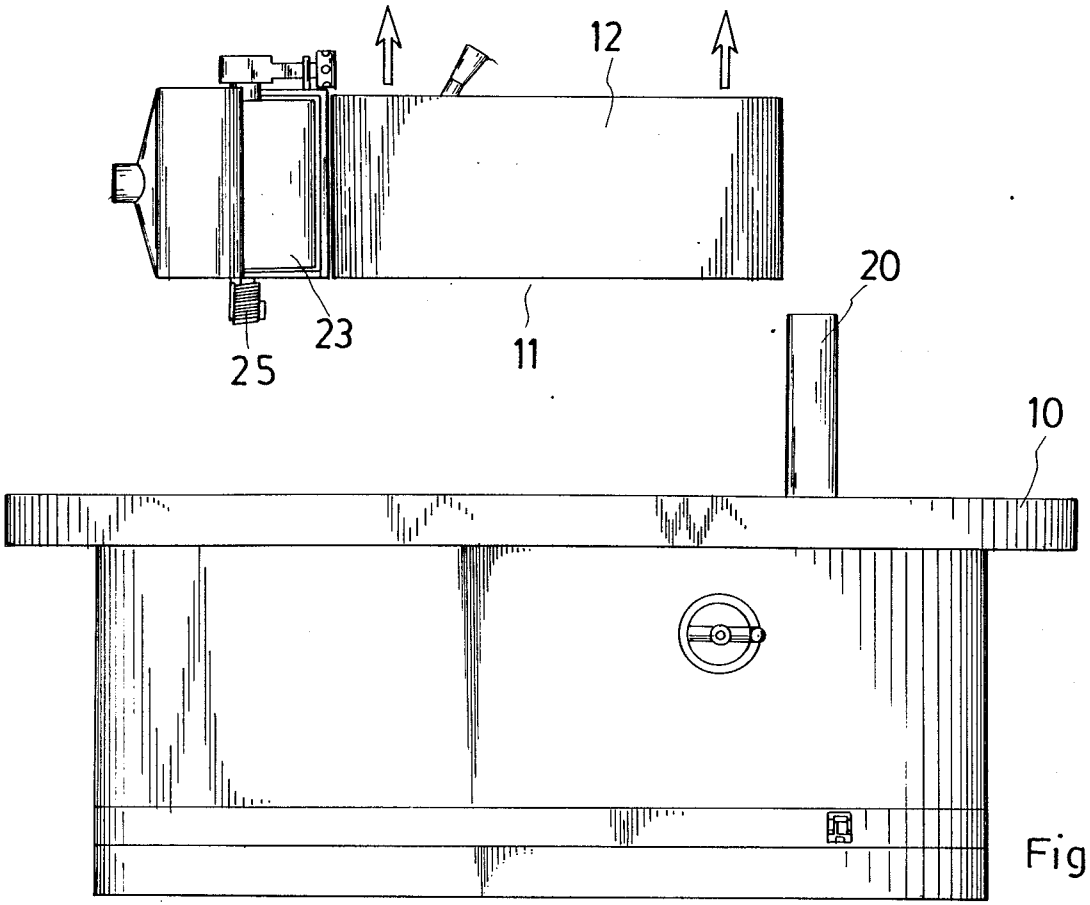
FIG. 3 is a schematic drawing, illustrating a process to assemble the present invention.
Figure 4:
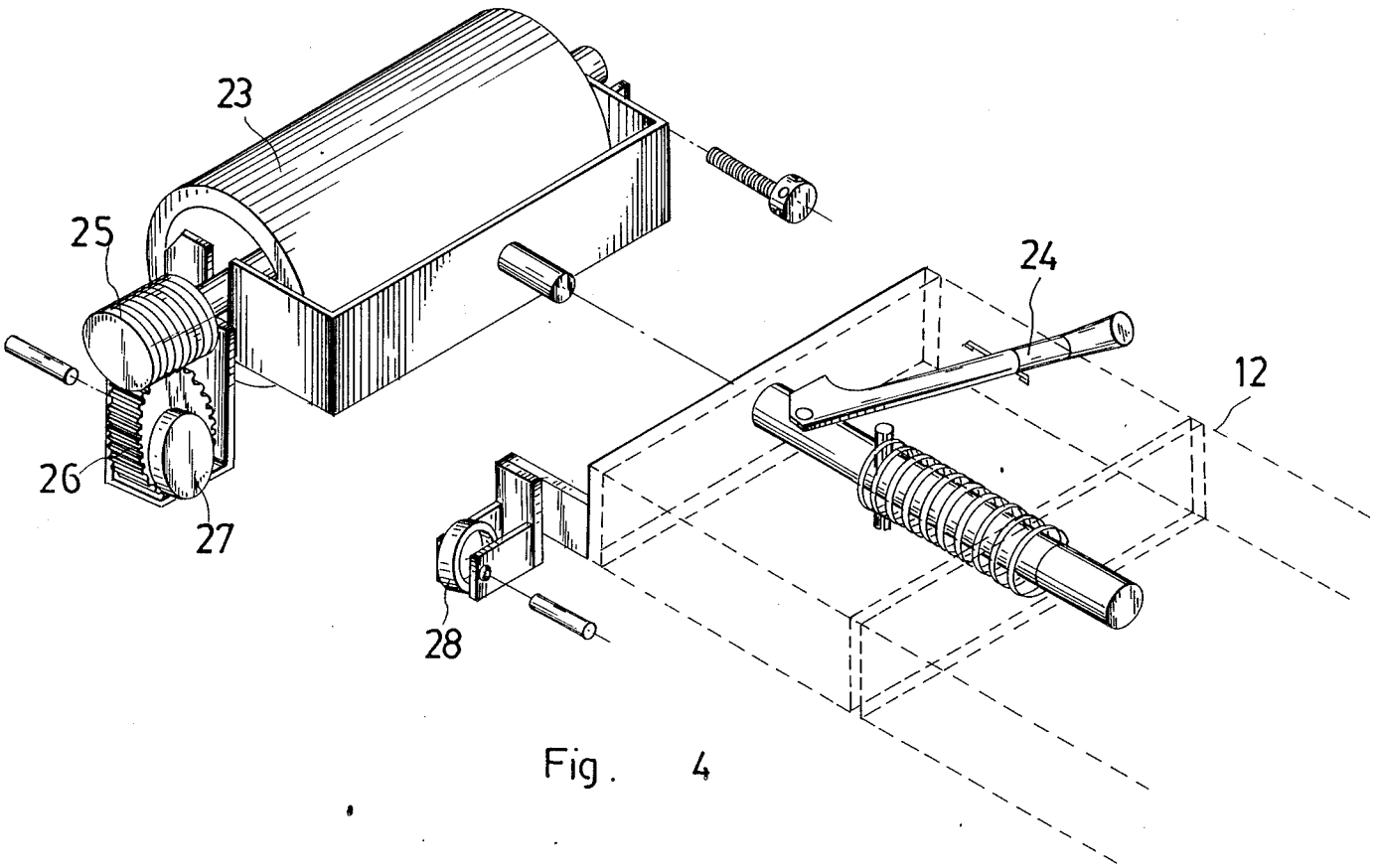
FIG. 4 is a partly perspective view of the present invention.
Figure 5:
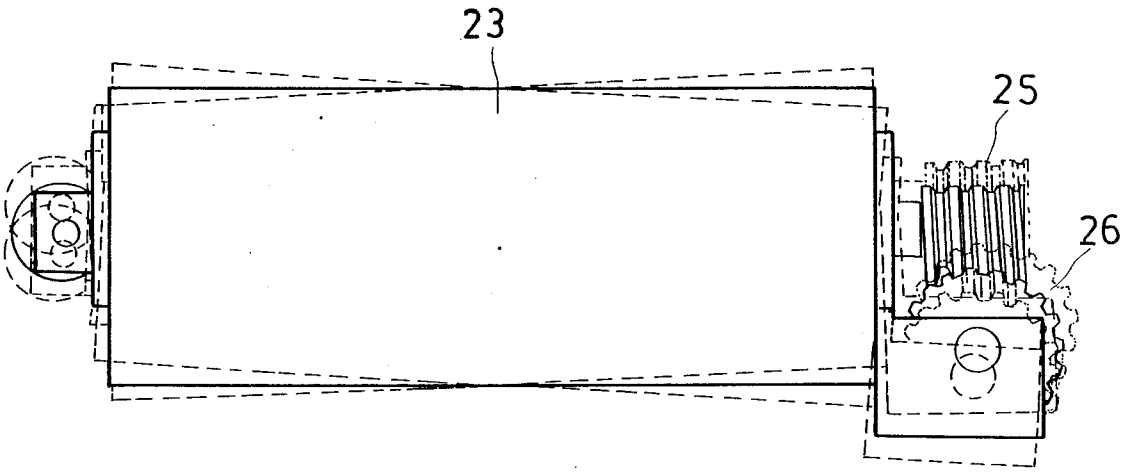
FIG. 5 is a schematic drawing, illustrating a grinding condition of the present invention.
Figure 6:
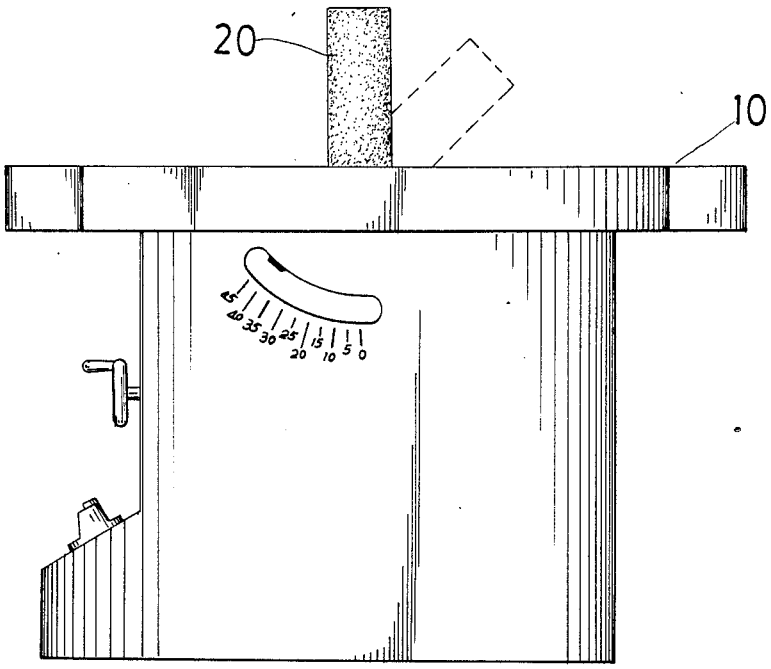
FIG. 6 is a schematic drawing, illustrating the angular position change of the grinding wheel.

As shown in FIG. 2, the present invention can be used for vertical grinding, and the angular position of the vertical grinding wheel 20 can be adjusted within a range of 45° for best griding performance (as shown in FIG. 6). When a horizontal grinding process is required, the horizontal grinding wheel head 11 is mounted on the base 10 within the opening 32, so that the grinding wheel 20 drives the abrasive belt 30 for grinding, which abrasive belt 30, as previously indicated, is mounted over the grinding wheel 20 and the abrasive belt wheel 23. During the grinding process, the rotation of the abrasive belt wheel 23 causes the worm 25 to drive the worm gear 26 to rotate concomitantly, and to further drive the eccentric wheel 27 contacting the roller wheel 28, such that the horizontal grinding wheel head 11 is driven to vibrate during grinding (as shown in FIG. 5), so as to reinforce grinding performance.

In conclusion, the present invention provides a grinding machine which can be used for horizontal grinding as well as vertical grinding for minimizing space consumption and cost, and which can provide a vibrating effect during the grinding process, to enhance grinding performance.

I claim:

1. A vertical/horizontal double-way grinding type abrasive belt grinder, which comprises:

a base with a horizontal top plate and an assembly chamber arranged within a portion of said top plate, said assembly chamber including an opening with four positioning blocks spaced about said opening and extending from a bottom of said top plate for holding a cover plate and a self-contained horizontal grinding wheel head;

a permanently mounted vertical grinding wheel arranged at a corner of said opening and having means for angular adjustment within an angle of 45° with respect to said top plate;

said horizontal grinding wheel head having an abrasive belt wheel and a housing both arranged to cooperate with said vertical grinding wheel for mounting an abrasive belt thereabout;

vibration means for vibrating said horizontal grinding wheel head contained within said horizontal grinding wheel head and including a worm coaxially connected to said abrasive belt wheel, a worm gear engaging said worm and having an eccentric wheel thereon, and a roller wheel extending from said housing and contacting said eccentric wheel;

wherein said vertical grinding wheel provides vertical grinding when said cover plate is mounted within said opening and drives said abrasive belt for horizontal grinding with vibrating motion when said horizontal grinding wheel head plate is mounted within said opening.

2. The veritcal/horizontal double-way grinding type abrasive belt grinder as set forth in claim 1, wherein said horizontal grinding wheel head includes a control lever means for controlling tension of said abrasive belt.

3. The vertical/horizontal double-way grinding type abrasive belt grinder as set forth in claim 1, wherein said vibrations means provides horizontal vibrating movement relative to said top plate.

* * * * *